US005196761A

United States Patent [19]

Majima et al.

[11] Patent Number: 5,196,761

[45] Date of Patent: Mar. 23, 1993

[54] COLOR CATHODE-RAY TUBE

[75] Inventors: Kazuo Majima; Tohru Sano, both of Mobara, Japan

[73] Assignee: Hitachi, Ltd., Tokyo, Japan

[21] Appl. No.: 669,577

[22] Filed: Mar. 14, 1991

[30] Foreign Application Priority Data

Mar. 14, 1990 [JP] Japan ..... 2-60970

[51] Int. Cl.[5] ..... H01J 29/81

[52] U.S. Cl. ..... 313/402; 358/245; 358/246; 335/214

[58] Field of Search ..... 313/402, 477 R, 313; 358/245, 246; 148/12 C, 12.1; 315/85; 335/212, 214

[56] References Cited

U.S. PATENT DOCUMENTS 4,609,412 9/1986 Kamio et al. ..... 148/12 C
4,616,154 10/1986 Brouha et al. ..... 313/402
4,769,089 9/1988 Gray ..... 148/12 C

FOREIGN PATENT DOCUMENTS 142633 6/1986 Japan .
185828 8/1987 Japan .

*Primary Examiner*—Donald J. Yusko
*Assistant Examiner*—Michael Horabik
*Attorney, Agent, or Firm*—Antonelli, Terry, Stout & Kraus

[57] ABSTRACT

In a shadow mask type color cathode-ray tube, the coercive force of the shadow mask frame, internal magnetic shield, shadow mask and reinforcing band is limited to a specific value when they are magnetized at specific magnetic field, in order to eliminate any adverse influences of environmental magnetic field.

6 Claims, 1 Drawing Sheet

COLOR CATHODE-RAY TUBE

BACKGROUND OF THE INVENTION

This invention relates to a shadow mask type color cathode-ray tube which is not affected so easily by an ambient magnetic field under a use state and also does not generate easily color nonuniformity, or the like, when the direction of installation of the cathode-ray tube is changed.

The direction of the paths of electron beams travelling from electron guns to a phosphor surface inside a cathode-ray tube are bent by the influences of magnetic field components crossing at right angles to the electron beams, as is well known in the art. If any external static magnetic field exists at the position where the cathode-ray tube is used, therefore, the points (positions) at which the electron beams impinge (beam landing) against the phosphor surface and excite the phosphor to emit light move in accordance with the intensity of the magnetic field.

In the shadow mask type color cathode-ray tube, a phosphor film is formed by aligning a large number of dots or stripes of three primary color phosphors having mutually different colors of emitted light, close to and adjacent one another. If the path of the electron beam emitted from the electron gun exclusive for each of the primary colors is bent by a component of an external static magnetic field orthogonal to the electron beam path, the electron beam path after passing through apertures of the shadow mask is bent, too. Therefore, the beam impinges against the phosphor of a different color adjacent to the phosphor of the color against which the beam should impinge originally on the phosphor film, and emits that color. In this manner, beam landing resulting in a so-called "color nonuniformity". An example of the external static magnetic field is a terrestrial magnetic field. Though its intensity is low, the terrestrial magnetic field exists everywhere under a normal use environment and its vertical component acts substantially similarly throughout the screen. The horizontal component of the terrestrial magnetic field does not affect the center portion of the screen when the display surface of the color cathode-ray tube faces south or north. However, since the electron beam path is not parallel to the horizontal component of the terrestrial magnetism near the four corners of the screen, the horizontal component functions to bend the electron beam path, as well. When the display surface of the color cathode-ray tube faces either east or west, the horizontal component affects every part of the screen. As is well, known even a mere change of an installing direction of a television receiver (to say nothing of a drastic change of the place of use of the television receiver) may require troublesome adjustment operations at the initial stage of television use.

In view of the problems described above, a large number of proposals have been made in the past so as to reduce or mitigate the influences of the external static magnetic field existing in the environment in which the color cathode-ray tube is used.

For instance, an arrangement wherein an internal magnetic shield which encompasses the space of passage of the electron beams by a high permeability soft magnetic material along the inner surface of a funnel of the housing of the color cathode-ray tube such as shown in FIG. 2 has long been employed. Incidentally, reference numeral 1 in FIG. 2 represents an electron gun; 2 is the funnel; 3 is a panel; 4 is a phosphor film; 5 is a shadow mask; 6 is the internal magnetic shield; 7 is a shadow mask frame; 8 identifies apertures of the shadow mask; 9 identifies electron beam landing points; and 10 is the electron beam. The internal magnetic shield 6 has a high permeability. Therefore, even if any external static magnetic field exists, the magnetic flux resulting from it is mainly induced in the internal magnetic shield material main body and the external static magnetic field affecting the electron beam path which scans the phosphor film is reduced inside the space encompassed by the internal magnetic shield 6. Though the majority of the magnetic flux resulting from the external static magnetic field is induced in the internal magnetic shield material main body, a magnetic field due to the external static magnetic field is generated in the space inside the internal magnetic shield 6, though it is limited. A problem does not occur if the influences of this limited magnetic field are within the allowable range where they are not recognized as color nonuniformity in practice. The influences of the terrestrial magnetic field changes not only when the position of use of a television receiver changes greatly but also when its installation direction is merely changed at the same position. In this case the influences of residual magnetism produced under the previous state exist even when no problem occurs in the original direction, and the influences of the terrestrial magnetic field sometimes exceed the allowable limit under a new state. To solve this problem, a method of disposing a demagnetizing coil which operates whenever a television set is turned on in proximity to the cathode-ray tube has been employed widely.

A positive compensation method is also known which disposes a canceller coil capable of offsetting exactly the external static magnetic field existing at the position of use of the color cathode-ray tube by adjusting a current, near the color cathode-ray tube. This method is a fundamental solution method if the troublesome adjustment operation and a high cost are neglected, and is used in a special case or for an extremely high precision tube but is not generally practical.

The internal magnetic shield and the demagnetizing coil which operates at the time of turn-on and turnoff of the television set have been employed widely at present as means for limiting the influences of the magnetic field of the use environment but they alone cannot remove always sufficiently remove the beam landing error resulting from the influences of the environmental magnetic field.

One of the causes which makes it difficult to solve this problem in practice (particularly in the case of television cathode-ray tubes for home use) is the cost of production. Proposals made recently for solving this problem are in line with two kinds of measures described above and seem to seek a solution with much efforts in detail while contemplating to establish a balance between the cost and performance.

Japanese Patent Laid-Open No. 185828/1987 describes that a shadow mask frame having excellent magnetic shield characteristics and less residual magnetism after demagnetization can be produced economically by shaping the shadow mask frame using a steel having a specific composition and then heat-treating it at a specific temperature. However, this reference does not describe a combination effect of the shadow mask frame with an internal magnetic shield, or the like.

Japanese Patent Laid-Open No. 142633/1986 discloses that an internal magnetic shield is composed of a material having a coercive force of not greater than 0.6 oersteds (47.7 A/m) such as a permalloy and an adjustable D.C. electromagnet is fitted to a suitable position on the outer surface of this internal magnetic shield by searching such a suitable position so that the electron beam landing state becomes optimal.

Japanese Patent Laid-Open No. 181252/1985 teaches to form a shadow mask using an aluminum killed steel material of a specific composition whose coercive force becomes 0.9~1.1 oersteds (71.6~87.5 A/m) after annealing but this reference also does not describe the combination effect with an internal magnetic shield, or the like.

In view of the fact that the magnetic characteristics of components of a color cathode-ray tube under the state of final use are governed greatly not only by the compositions of the raw materials but also by mechanical and thermal machining conditions (including annealing) till the color cathode-ray tube is assembled, the present invention is directed to provide a color cathode-ray tube equipped with a member useful for shielding an electron beam path from an external static magnetic field in order to eliminate any adverse influences of the external static magnetic field on the electron beam orbit inside the color cathode-ray tube.

To accomplish the object described above, the present invention stipulates that coercive force of both the shadow mask frame and internal magnetic shield in a shadow mask type color cathode-ray tube is to be smaller than 90 A/m when they are magnetized at 800 A/m, respectively.

Generally speaking, a shadow mask tends to naturally become magnetically soft from the aspect of production process when a ferromagnetic material is used as a raw material, and the present invention stipulates also that the coercive force of this shadow mask is to be smaller than 90 A/m when it is magnetized at 800 A/m.

In the present color cathode-ray tubes, the outer periphery of a panel skirt of a housing is clamped by a so-called reinforcing band to prevent explosion and contraction. The present invention stipulates also that coercive force of this reinforcing band is to be smaller than 250 A/m when the reinforcing band is magnetized at an impressed magnetic field of 800 A/m.

Magnetic characteristics of a ferromagnetic material change greatly due to its mechanical and thermal machining history. The present invention attempts to stipulate the conditions which provide a color cathode-ray tube that can be used sufficiently practically inside an ordinary environmental magnetic field under the state of final use after various machining when a soft steel type raw material available relatively easily at present is used primarily, irrespective of the kind of the starting material so long as the conditions stipulated by the present invention are satisfied.

Therefore, the value of the relatively high magnetic field which is first impressed to the sample and the value of a reverse magnetic field to eliminate any residual magnetism after removing the magnetic field or in other words, the value of coercive force, are set to necessary and sufficient values by inspecting the characteristics of color cathode-ray tubes that are completed practically. It has been confirmed also that high permeability which is essential to a magnetic shield material is simultaneously guaranteed by the relatively simple conditions described above.

DESCRIPTION OF THE PREFERRED EMBODIMENTS

In a first embodiment of the invention, a shadow mask frame uses a composition comprising 0.0021 wt % of C (hereinafter the term "%"represents "wt %"), 0.0018% of N, 0.17% of Mn, 0.012% of Si, 0.014% of P, 0.015% of S, 0.063% of sol. Al (acid soluble Al) and the balance consisting of Fe and other unavoidable impurities, and it has a coercive force of 50~70 A/m at an impressed magnetic field of 800 A/m. An internal magnetic shield uses a composition comprising 0.0006% of C, 0.01% of Si, 0.23% of Mn, 0.011% of P, 0.003% of S, 0.003% of sol. Al and the balance consisting of Fe and other unavoidable impurities, and it has a coercive force of 65~80 A/m at an impressed magnetic field of 800 A/m. Nonuniformity of color, or the like, cannot be observed in this case.

In a second embodiment, the shadow mask frame and the internal magnetic shield use the same compositions as those of the first embodiment, respectively, and furthermore, an Fe-Ni alloy is used as the material of a shadow mask. The coercive force is set to be 30~40 A/m at the same impressed magnetic field as that of the first embodiment, and a color cathode-ray tube free from the influences of terrestrial magnetism can be obtained.

In a third embodiment, the shadow mask frame and the internal magnetic shield use the same compositions as those of the first embodiment, respectively, the shadow mask uses the same material as that of the second embodiment and furthermore, a reinforcing band uses the composition comprising 0.005% of C, 0.19% of Mn, 0.019% of P, 0.007% of S and the balance consisting of Fe and other unavoidable impurities and coercive force is set to 230~250 A/m at an impressed magnetic field of 800 A/m, as tabulated in Table 1. There is thus obtained a color cathode-ray tube free from the influences of terrestrial magnetism.

TABLE 1

Magnetic characteristics of constituents of third embodiment

| | third embodiment | conventional example |
|---|---|---|
| shadow mask frame | 50~70 A/m | 175~190 A/m |
| internal magnetic shield | 65~80 A/m | 150~165 A/m |
| shadow mask | 30~40 A/m | 30~40 A/m |
| reinforcing band | 230~250 A/m | 290~320 A/m |

Figure 1:
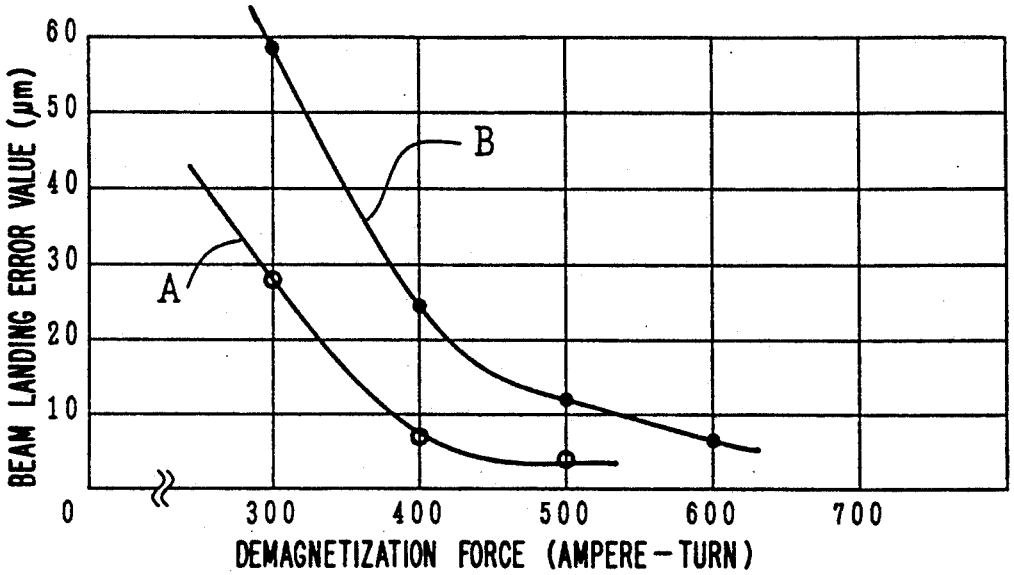
FIG. 1 is a diagram showing comparatively the beam landing characteristics A of a color cathode-ray tube in accordance with an embodiment of the present invention and the beam landing characteristics B of a conventional color cathode-ray tube.
Figure 2:
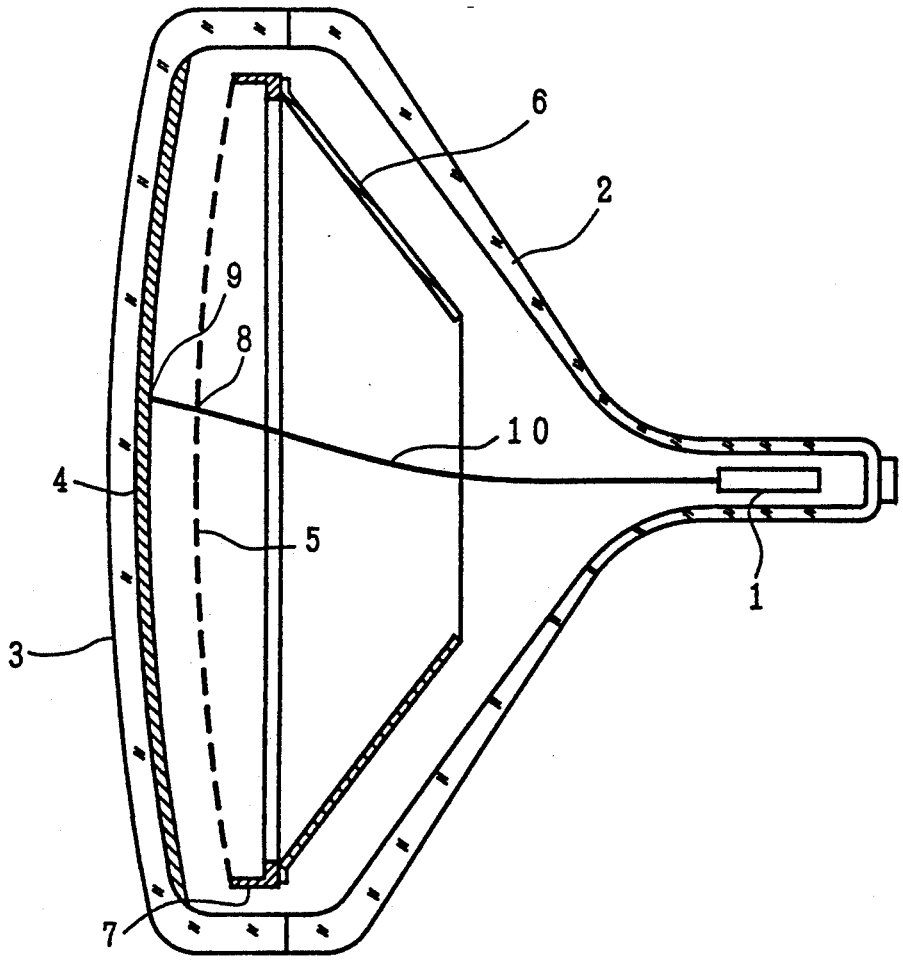
FIG. 2 is an explanatory view useful for explaining the function of an internal magnetic shield of a color cathode-ray tube.

FIG. 1 shows comparatively the beam landing characteristics A of the color cathode-ray tube constituting the third embodiment and the beam landing characteristics B of a conventional color cathode-ray tube. The abscissa represents demagnetization in terms of ampere-turn and the ordinate represents a landing error value of electron beams resulting from remaining demagnetization in terms of $\mu$m. The sample in this case is prepared so that its initial flux density is $8\times10^{-5}$ T (Tesra). When a demagnetization coil having demagnetization of 400 ampere-turns is used, the landing error in this embodiment drops to about 40% of the error of the conventional example.

Although the description given above relates to examples of the compositions for the shadow mask frame, internal magnetic shield and reinforcing band, the present invention is not naturally limited to these examples of the compositions.

As described above, the present invention can provide a color cathode-ray tube having a restricted electron beam landing error and having high color purity and high white uniformity.

We claim:

1. A shadow mask system color cathode-ray tube, comprising a shadow mask having a shadow mask frame and an internal magnetic shield, which are exposed to a magnetic field which is applied in an area including said shadow mask and said internal magnetic shield, wherein the coercive force of each of said shadow mask frame and said internal magnetic shield is smaller than 90 A/m at an applied magnetic field of 800 A/m.

2. A color cathode-ray tube according to claim 1, wherein the coercive force of the shadow mask is smaller than 90 A/m at an applied magnetic field of 800 A/m.

3. A color cathode-ray tube according to claim 1 or 2, wherein the coercive force of a reinforcing skirt for preventing implosion is smaller than 250 A/m band for clamping the outer periphery of a panel at an applied magnetic field of 800 A/m.

4. A shadow mask system color cathode-ray tube, comprising a shadow mask having a shadow mask frame and an internal magnetic shield, wherein a reverse magnetic field as represented by the coercive force of each of the shadow mask frame and said internal magnetic shield, is smaller than 90 A/m, when the shadow mask frame and the internal magnetic shield are magnetized at an impressed magnetic field of 800 A/m.

5. A color cathode-ray tube according to claim 4, wherein said coercive force of the shadow mask is smaller than 90 A/m, when it is magnetized at said impressed magnetic field of 800 A/m.

6. A color cathode-ray tube according to claim 4 or 5, wherein said coercive force of a reinforcing band for clamping the outer periphery of a panel skirt for preventing implosion is smaller than 250 A/m, when it is magnetized at said impressed magnetic field of 800 A/m.

* * * * *